United States Patent [19]

Pizzi et al.

[11] Patent Number: 4,588,302

[45] Date of Patent: May 13, 1986

[54] DEVICE FOR QUICKLY LOCKING THE PAINT CONTAINING VESSELS IN APPARATUS FOR MIXING PAINTS AND THE LIKE

[76] Inventors: Giordano Pizzi; Domenico Gargioni, both of Via Meucci, 28, 20083 Gaggiano (MI), Italy

[21] Appl. No.: 686,823

[22] Filed: Dec. 27, 1984

[30] Foreign Application Priority Data

Jan. 4, 1984 [IT] Italy ..... 20420/84[U]

[51] Int. Cl.[4] ..... B01F 15/00

[52] U.S. Cl. ..... 366/349; 366/209; 366/605; 100/219; 100/264

[58] Field of Search ..... 366/349, 209, 348, 605; 51/217 R, 217 T, 216 T; 403/DIG. 1; 292/256, 256.65; 141/455; 100/164, 244, 219

[56] References Cited

U.S. PATENT DOCUMENTS

| | | | |
|---|---|---|---|
| 19,413 | 2/1858 | Duchamp | 100/264 |
| 24,258 | 5/1859 | Bond | 100/264 |
| 594,663 | 11/1897 | Swinnerton | 100/264 |
| 4,134,689 | 1/1979 | Sorensen | 366/605 |
| 4,281,936 | 8/1981 | Schotter | 366/209 |

*Primary Examiner*—Robert W. Jenkins

*Attorney, Agent, or Firm*—Bucknam and Archer

[57] ABSTRACT

There is disclosed a device for locking the paint containing vessels in apparatus for mixing or blending paints and the like, comprising two movable plates firmly coupled to corresponding parallely extending supporting rods, each supporting a fixed gear wheel at the central portion of which there is provided a lever forming one of the two ends of an open frame structure and on which there are pivoted two arms, in turn pivoted to the movable plates, on which there are coupled two vessel clamping rotatable disks.

1 Claim, 5 Drawing Figures

DEVICE FOR QUICKLY LOCKING THE PAINT CONTAINING VESSELS IN APPARATUS FOR MIXING PAINTS AND THE LIKE

BACKGROUND OF THE INVENTION

The present invention relates to a device for quickly locking the paint containing vessels for mixing painting substances or the like suspensions.

As it is well known, because of the trend of the paints making industries to supply their products in a minimum number of main colours, to be directly blended by the user in order to obtain the desired colouring, small mixing or blending devices have been designed which are able of homogenizing the paint components in order to obtain the desired colour.

Also known is the fact that the mentioned mixing or blending devices use, for the mixing operation the same vessel therein the base paint is contained and are based on the principle of causing said vessel, after the proper additions of colouring products, to be simultaneously driven in two perpendicular directions, that is about the longitudinal axis of the vessel and about an axis perpendicular to the latter, in order to evenly distribute the end product.

More specifically, those mixing devices are generally provided with a rotating cage, provided with two plates, also rotatable, effective to support the vessel and the painting product therein and adjustable in mutual positions in order to be able of fitting to different size vessels.

In the conventional types of mixing devices, the rotatable plates are approached to one another or moved away from one another by pivoting said plates or discs on further movable plates.

The latter are helicoidally coupled, respectively with a right and left hand, to threaded small columns or rods the rotation whereof is such as to cause said plate to be displaced in opposite directions.

That rotary movement is generally obtained by means of a series of gear members, associated with a gear wheel provided with a suitable driving arm.

It should be noted to that connection that, since the movement of the mentioned plates is obtained through a screw-nut type of drive, the approaching and moving away of the rotatable plates, provided for clamping the vessels, are rather slow, thereby requiring the intervention of long duration by an operator.

Moreover the clamping assembly having the above disclosed construction is of a comparatively high cost, both because of the need of threading the mentioned rods and the provision of a number of gear members.

SUMMARY OF THE INVENTION

Accordingly, the task of the present invention is to overcome the above mentioned drawbacks by providing a device for locking the paint containing vessels in apparatus for mixing or blending paints and the like which affords the possibility of clamping said vessels, between the rotating plates, in a very quick manner.

Within the above task, it is a main object of the present invention to provide a device for locking the paint containing vessels in apparatus for mixing or blending paints and the like, which comprise a reduced number of cooperating components, thereby providing a very reliable assembly.

According to one aspect of the present invention the above task and objects, as well as yet other objects which will become more apparent thereinafter, are achieved by a device for locking the paint containing vessels in apparatus for mixing or blending paints and the like, as claimed in the accompanying claim.

BRIEF DESCRIPTION OF THE DRAWINGS

Further characteristics and advantages of the device for locking the paint containing vessels in apparatus for mixing or blending paints according to the present invention, will become more apparent thereinafter from the following detailed description of a preferred embodiment thereof, being illustrated, by way of an indicative example, in the figures of the accompanying drawings, where.

DESCRIPTION OF THE PREFERRED EMBODIMENTS

With reference to the figures of the accompanying drawings, the device for locking the paint containing vessels in apparatus for mixing or blending paints according to the present invention, comprises, slidingly supported on a substantially metal rigid frame, two slidingly movable cross upper and lower plates 1 and 1' which extend in parallel planes and bear rotatably corresponding rotatable plates or disks, indicated respectively at 2 and 2'. In particular, the upper rotatable disk 2 is coupled, through a vertical shaft **2*a* to a driving pulley 4*a* which in turn may be driven, through an electric motor-belt-combination (not shown), to rotate said upper disk 2, either continuously or in an intermittent swinging way in the clockwise and anticlockwise directions. In turn the lower disk 2' is idly rotatively supported on the mentioned plate 1'**.

The movable plates, in turn, are firmly coupled, through corresponding throughgoing holes, to two vertical small columns or rods 3 and 3' also parallely extending, rigid with a ring member 4 able of rotating and which forms a main part of the mixer.

Figure 1:
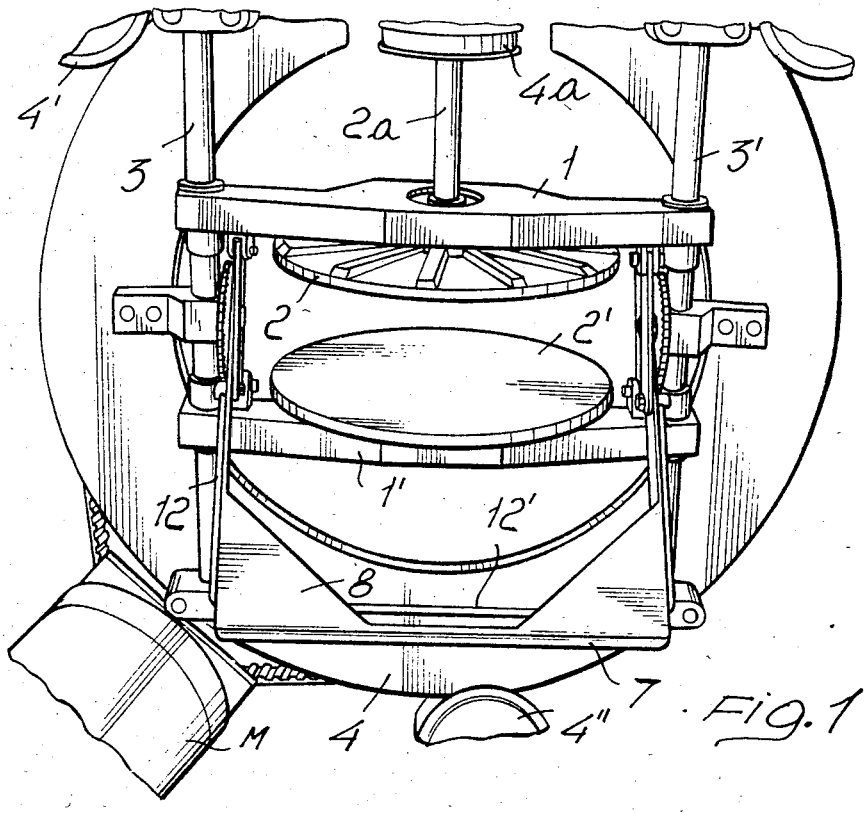
FIG. 1 is a schematic front view illustrating the device according to the present invention.
Figure 2:
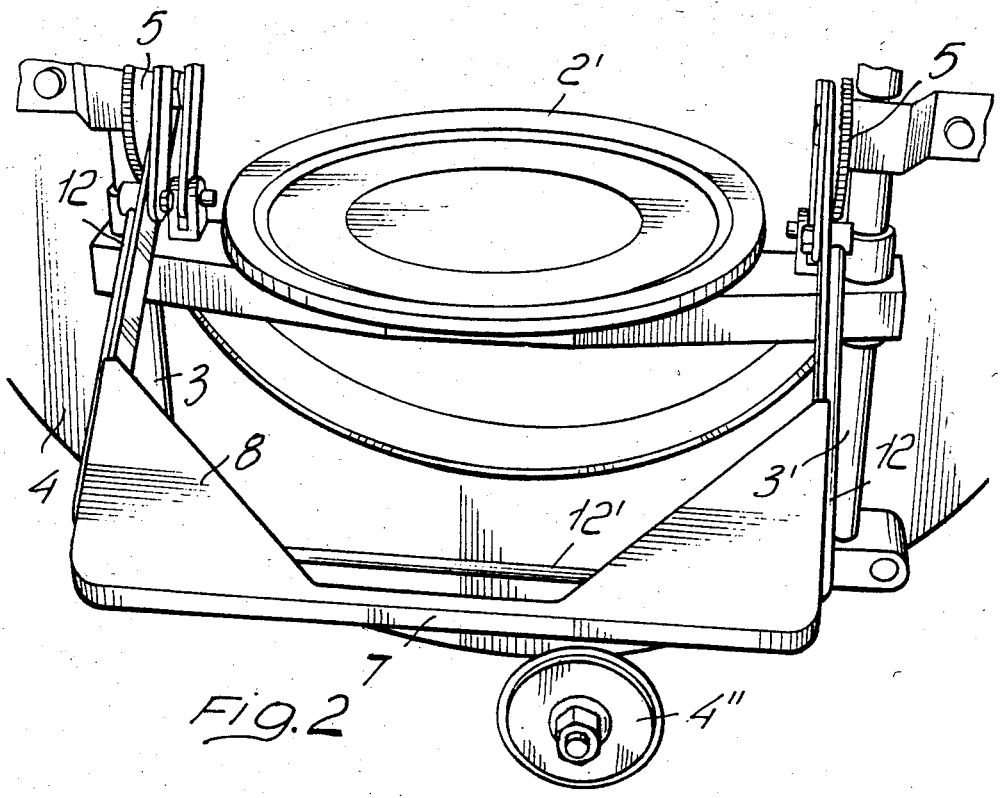
FIG. 2 is a detail view illustrating the part of the device for simultaneously rotating the two levers for displacing the movable plates.

In particular the ring member 4 is arranged in a substantially vertical plane and is rigid with and constitutes a main part of the mixing apparatus frame and is specifically provided for imparting to the paint vessels (not shown) to be clamped between the plates 1 and 1' a swinging movement in two directions in a substantially vertical plane. To this end the periphery of the ring member 4 is operatively engaged with one or more driving small pulleys (one of which is indicated at 4' in FIG. 1) operated through a known type of linkage or belt (as shown) by an electric motor M, further idle pulleys being moreover provided (of which one has been indicated by 4'' in FIG. 1) also engaging the periphery of the ring member 4 to guide its swinging movement in the clockwise and anticlockwise directions, which may be obtained in any known ways, for example by a proper designing of the mentioned linkage or by using a reversible type of electric motor M.

Figure 3:
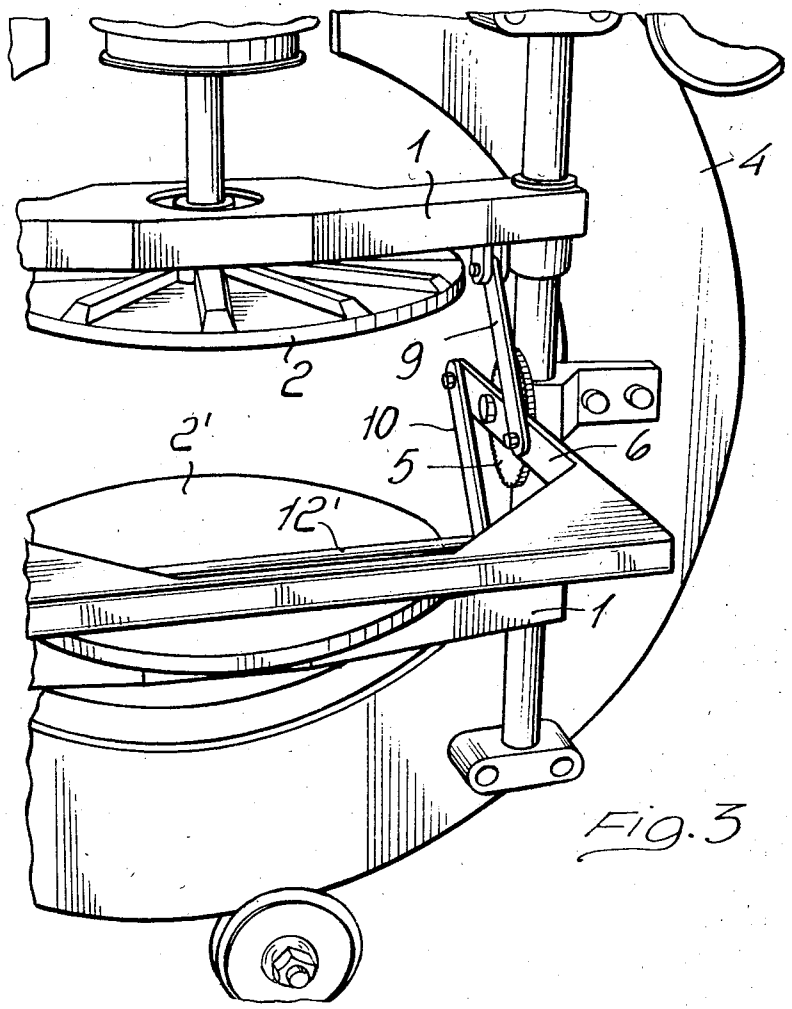
FIG. 3 is a perspective detail view illustrating the mechanism driven or controlled by the mentioned levers.
Figure 4:
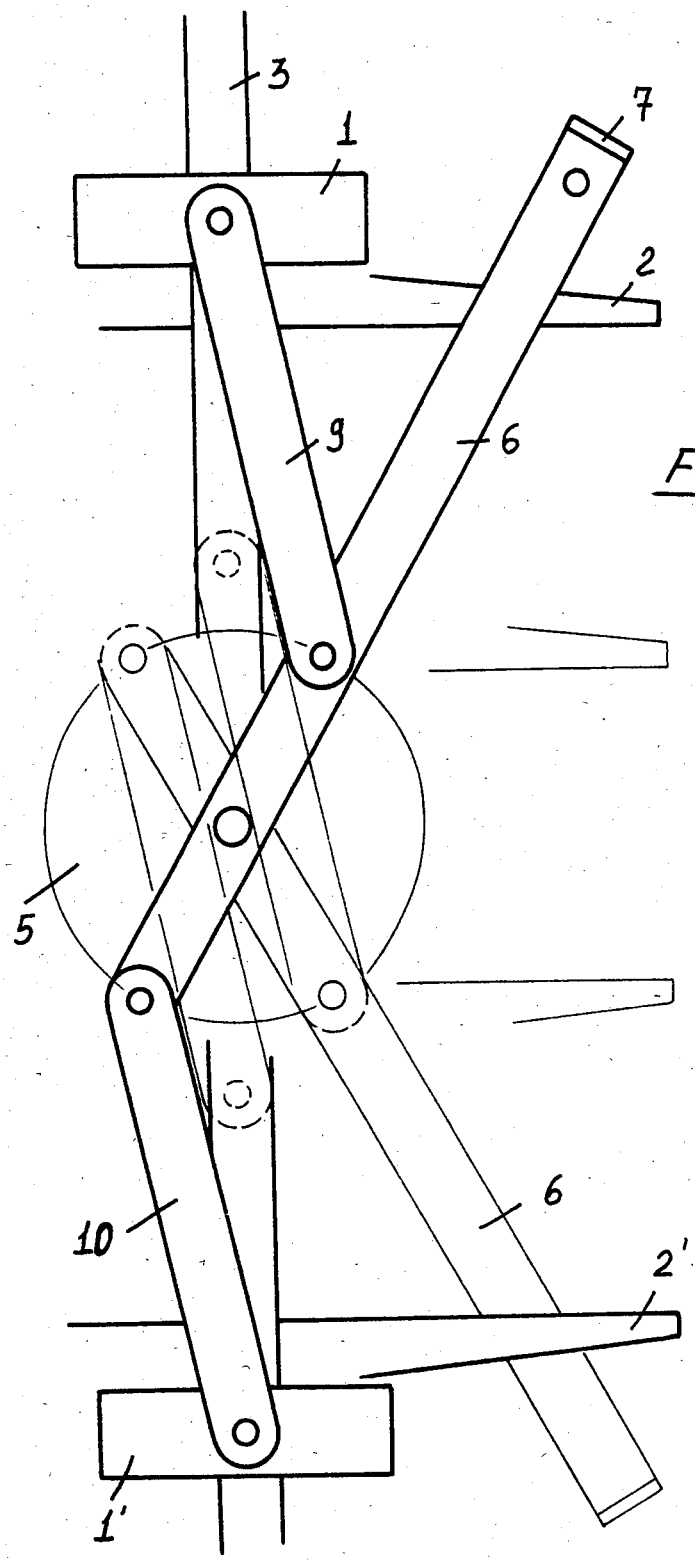
FIG. 4 is a schematic side view illustrating that same mechanism.

One each said rod there is mounted, at an intermediate position, a gear wheel 5, (see in particular FIG. 3) of the saw tooth type, at the central portion whereof there is pivoted a end portion of a lever 6.

The two above mentioned levers are coupled by a cross member 7 thereabout there is arranged a suitable box-like body, 8, effective to provide a grip portion.

At the end portions of said levers there are pivoted, at equispaced and opposite positions, with respect to the pivot point of said levers, two like length arms 9 and 10 which are pivoted, at the other ends, to the plates 1 and 1'.

In actual practice, thereby, by acting on the cross member which couples the two levers, in such a way as to cause the latter to rotate in a direction or in the opposite direction, the plates 1, 1', and the disks 2 and 2' supported thereby are caused to approach one another or move away from one another.

The locking of the mentioned levers, in the desired position, corresponding to the proper clamping of a vessel between the disks 2 and 2' may be obtained by means of a respective hook member 11 (one for each lever), pivoted to said levers, or by means of sharpened rods 12, effective to slide parallely to the levers and also coupled by a cross member, indicated at 12' and rigid with the box like body or operating handle 8.

Figure 5:
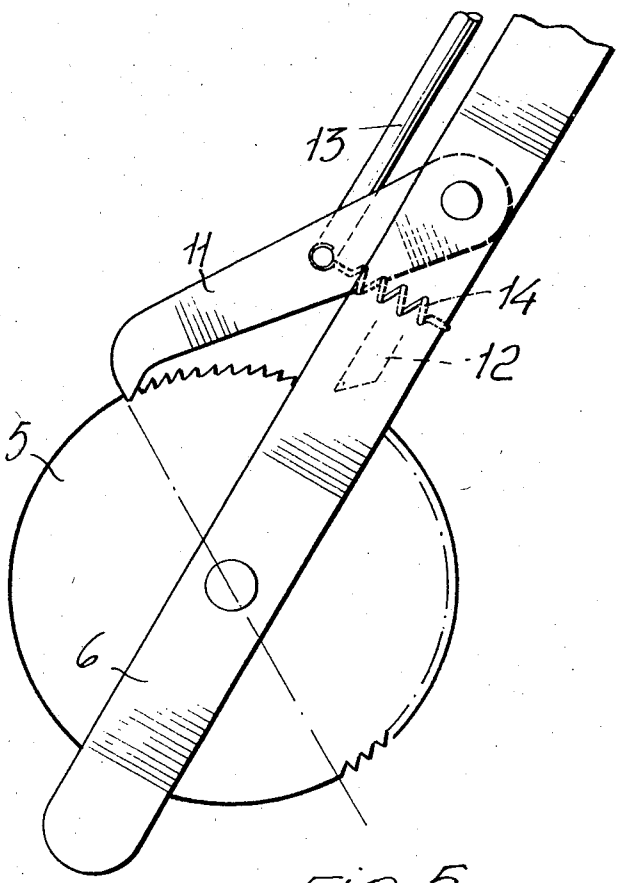
FIG. 5 illustrates possible means for locking at the desired position the mentioned mechanism.

In particular the locking means according to the invention has been shown, for a single lever 6, in the detail view of FIG. 5, in which there are represented the two possible embodiments of said locking means, i.e. that using the hooked member 11 pivoted on the respective lever 6 and engaging by its pointed free end with the teeth of the toothed wheel 5, and that using a mentioned pointed rod 12, also effective to engage with the teeth of the wheel 5. It should be noted that, owing to the provision of the cross member or rod 12 coupling the other hook member 11 or rod 12 to the disclosed hook member 11 and rod 12, the locking of the disk may be carried out contemporaneously.

That cross member 12, counterbiassed by one or more springs housed in the box-like body 8 may also cooperate with a respective rod 13 coupled to the hook members and effective to disengage the hook members 11, which is normally biassed by a respective return spring 14, from the teeth of the wheel 5.

The operation of the above disclosed paint vessel locking device should be apparent from the above disclosure.

More specifically, after having located the paint vessel on the lower disk 2', the handle 8 will be operated to cause the disks 2, 2' to approach in such a way as to clamp therebetween the paint vessel or can (not shown), and lock it firmly by the disclosed locking means. It should be noted that this operation, differently from the known apparatus therein there are used slow action screw arrangements, will be a very quick one, thereby the subject apparatus will be able of processing a lot of paint cans in a comparatively short time.

Then the electric motor M is operated to swingable actuate the ring member 4 and rotate the pulley **4*a*, thereby the paint can will be subjected to a swinging movement in a substantially vertical plane and a further swinging movement imparted to the can by the upper disk 2 driven, as aforesaid, through the mentioned pulley 4*a***. Thus the paint will be throughly mixed, in a very short time.

While a preferred embodiment of the device for locking paint containing vessels in apparatus for mixing or blending paints has been thereinabove disclosed, it should be noted that it it is susceptible to several modifications and variations all of which come within the scope of the invention.

What we claim is:

1. A device for locking the paint containing vessels in apparatus for mixing or blending paints, comprising a substantially rigid metal frame including two parallelt extending vertical small columns slidingly supporting two upper and lower cross plates, said plates rotatably supporting thereon respective upper and lower disk members effective to be moved towards one another for clamping a said paint vessel therebetween, the upper disk member being rotatively driven through a pulley-belt drive and the lower disk member being substantially rotatably idly supported on said lower plate, a ring member being provided, essentially rigid with said frame and engaging, at the periphery thereof, with a plurality of pulleys, at least one whereof is a driving pulley operated by an electric motor effective to impart to said ring member and frame a swinging rotatable movement in the two directions, each said column further supporting, at an intermediate position thereof, a fixed saw tooth gear wheel at the central portion of which there is pivoted a respective lever forming one of the two ends of a structure like an open frame, said levers being coupled by a cross member encompassed by a box-like body effective to provide a grip portion, on each said lever there being pivoted, at two opposite and equispaced points of its pivot, two like length arms, in turn pivoted to said plates, a respective hook member being provided, each pivoted to a said respective lever for engaging with the teeth of a respective said saw tooth gear wheel for locking said plates at a desired position, the two hook members being coupled by a cross member biased by at least a hook disengaging spring member.

* * * * *